US006291594B1

(12) United States Patent
Rodrigues

(10) Patent No.: US 6,291,594 B1
(45) **Date of Patent: *Sep. 18, 2001**

(54) TEXTILE SIZES CONTAINING ANHYDRIDE BASED GRAFT COPOLYMERS

(75) Inventor: Klein A. Rodrigues, Signal Mountain, TN (US)

(73) Assignee: National Starch and Chemical Investment Holding Corporation, Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/047,051

(22) Filed: Mar. 24, 1998

(51) Int. Cl.[7] ..... C08F 120/08; C08F 120/66; C08F 122/04; C08F 20/66; C08F 220/04; C08F 8/30

(52) U.S. Cl. ..... 525/327.6; 525/327.7

(58) Field of Search ..... 525/327.6, 327.7

(56) References Cited

U.S. PATENT DOCUMENTS

| | | | | |
|---|---|---|---|---|
| 3,981,836 | * | 9/1976 | Pangle, Jr. | 260/29.6 H |
| 4,207,223 | * | 6/1980 | Schulde et al. | 260/29.6 WB |
| 4,216,260 | | 8/1980 | Buckley | 428/261 |
| 4,275,176 | * | 6/1981 | Login | 525/48 |
| 4,367,308 | | 1/1983 | Login | 525/44 |
| 4,382,128 | * | 5/1983 | Li | 524/513 |
| 4,756,714 | * | 7/1988 | Hendrix et all. | 8/115.6 |
| 5,013,775 | * | 5/1991 | Oikawa et al. | 524/107 |
| 5,420,180 | | 5/1995 | Katayama et al. | 428/375 |
| 5,482,747 | | 1/1996 | Hayes et al. | 427/341 |
| 5,580,941 | | 12/1996 | Krause et al. | 527/300 |

* cited by examiner

*Primary Examiner*—James J. Seidleck
*Assistant Examiner*—U. K Rajguru
(74) *Attorney, Agent, or Firm*—Thomas F. Roland

(57) ABSTRACT

Compositions useful for textile sizes which contain anhydride based graft copolymers. The anhydride based graft copolymers are the reaction product of an ethylenically unsaturated monomer, an anhydride monomer selected from maleic anhydride and itaconic anhydride, either a monofunctional polyglycol having a hydroxyl or amine terminal group or a polyfunctional polyglycol having a weight average molecular weight of greater than 5,000 and at least one terminal hydroxyl group, and a free radical initiator. The anhydride based graft copolymers provide lubrication during sizing and a thorough removal of waxes and oils during desizing and scouring.

18 Claims, No Drawings

TEXTILE SIZES CONTAINING ANHYDRIDE BASED GRAFT COPOLYMERS

FIELD OF THE INVENTION

This invention relates to compositions useful for textile sizes, and in particular to anhydride based graft copolymers which provide lubrication during sizing and a thorough removal of waxes and oils during desizing and scouring.

BACKGROUND OF THE INVENTION

In the textile industry it is common to treat fibers with a sizing composition prior to the weaving process. In the sizing treatment, the size composition adheres to and binds together fibers thereby lubricating and strengthening the fibers. Lubricated fibers allow for faster speeds to be used in the subsequent weaving operation without building up as much static electricity as compared to untreated fibers, and strengthened fibers are more resistant to abrasion and breaking during the weaving operation.

Many types of polymers have been used as sizing agents in the sizing of textiles. These sizing agents include, for instance, starch, starch derivatives, gelatin, polyvinyl alcohol, acrylics, alkali metal salts of maleic anhydride/styrene copolymers, and sulfonic acid metal salt derivatives of polyesters. The disadvantages associated with the use of such sizing agents are that they form brittle hard films on fibers and thus require the addition of waxy type lubricants in order to provide lubrication during sizing. These waxy type lubricants are typically oils and fats which are difficult to remove with water during desizing because they are hydrophobic. Additionally, such sizing agents are characterized by poor soil release properties and thus do not effectively remove the natural and synthetic waxes from the fibers during desizing or scouring. Furthermore, such sizing agents, in particular starch and polyvinyl alcohol, are difficult to resolubilize due to hydrogen bonding even in an alkaline medium and thus are difficult to remove during desizing.

SUMMARY OF THE INVENTION

Accordingly it is an object of the present invention to provide a sizing composition which provides lubrication to fibers during sizing without the addition of waxy type lubricants.

It is also an object of the invention to provide a sizing composition which is effectively removed during desizing.

It is another object of the invention to provide a sizing composition which effectively removes natural and synthetic waxes from fibers during desizing and/or scouring.

With regard to the foregoing and other objects, the present invention provides a sizing composition comprising 1 to 50 weight percent, based on the total weight of the sizing composition, of and anhydride based graft copolymer which comprises the reaction product of an ethylenically unsaturated monomer, an anhydride monomer selected from the group consisting of maleic anhydride, itaconic anhydride, and mixtures thereof, either a monofunctional polyglycol having a hydroxyl or amine terminal group or a polyfunctional polyglycol having a weight average molecular weight of greater than 5,000 and at least one terminal hydroxyl group, and a free radical initiator to form an anhydride based graft copolymer.

According to another aspect the invention provides a sizing composition comprising 1 to 50 weight percent, based on the total weight of the sizing composition, of an anhydride based graft copolymer which is prepared by a two-step process comprising reacting an ethylenically unsaturated monomer and an anhydride monomer selected from the group consisting of maleic anhydride, itaconic anhydride, and mixtures thereof, and a free radical initiator, in the presence of a solvent; and isolating the product from the solvent and reacting the product with either a monofunctional polyglycol having a hydroxyl or amine terminal group or a polyfunctional polyglycol having a weight average molecular weight of greater than 5,000 and at least one terminal hydroxyl group, to form an anhydride based graft copolymer.

An additional aspect of the invention provides an improved process for preparing woven textiles comprising: (a) sizing fibers to be woven with an aqueous solution of an anhydride based graft copolymer which comprises the reaction product of an ethylenically unsaturated monomer, an anhydride monomer selected from the group consisting of maleic anhydride, itaconic anhydride, and mixtures thereof, either a monofunctional polyglycol having a hydroxyl or amine terminal group or a polyfunctional polyglycol having a weight average molecular weight of greater than 5,000 and at least one terminal hydroxyl group, and a free radical initiator; (b) weaving the sized fibers to produce woven textile material; (c) desizing the woven textile material with an aqueous alkaline solution; and (d) washing the alkaline desized woven textile material with water.

Sizing compositions prepared using the anhydride based graft copolymers of the invention form a waxy film on fibers and thus provide effective lubrication without the addition of waxy-type lubricants which are typically added to size compositions in order to lubricate the fibers. In addition, size compositions prepared using the anhydride based graft copolymers of the invention exhibit excellent soil release properties due to the hydrophobic backbone and hydrophillic chains of the anhydride based graft copolymer, and thus provides a more complete removal of natural and synthetic waxes and oils from fabrics during desizing as compared to conventional sizes. During sizing, the anhydride based graft copolymer is preferably in intimate contact with the fibers which enhances the soil removal properties of the sizes prepared therefrom. Moreover, due to the hydrophilic nature of the anhydride based graft copolymer, the copolymer is soluble in alkaline medium and is readily desized. In addition, articles sized with the sizing compositions of the invention may not require a scouring step due to the cleaning ability of the anhydride based graft copolymer during desizing.

DESCRIPTION OF THE INVENTION

This invention provides an improved sizing composition for treating textiles. Suitable textiles are, for example, cotton, polyacrylics, polyamides, polyesters, polyolefins, rayons, wool, and blends thereof. The sizing composition is prepared from an anhydride based graft copolymer. The anhydride based graft copolymer is prepared either by a one-step or a two-step process. In the one-step process, the anhydride based graft copolymer is prepared by reacting an ethylenically unsaturated monomer, an anhydride monomer selected from the group consisting of maleic anhydride, itaconic anhydride, and mixtures thereof, a monofunctional polyglycol having a hydroxyl or amine terminal group, in the presence of a free radical initiator in a polymerization reactor. No solvent is used in the one-step process. In one embodiment of a one-step process, the anhydride based graft copolymers involves heating a mixture containing the monomers, polyglycol, and free radical initiator to cause the monomers to polymerize, and then heating the polymer at a higher temperature in the presence of polyglycol for a sufficient period of time to form the anhydride based graft copolymer. A solventless method for preparing anhydride based graft copolymers is described in U.S. patent application Ser. No. 09/047,032, entitled, "In Situ Solvent Free Method For Making Anhydride Based Graft Copolymers", filed Mar. 24, 1998, which is hereby incorporated by reference in its entirety.

In the two-step process, the anhydride based graft copolymer is prepared by reacting an ethylenically unsaturated monomer and an anhydride monomer selected from the group consisting of maleic anhydride, itaconic anhydride, and mixtures thereof, in the presence of a solvent and a free radical initiator, to prepare a copolymer which is reacted with a monofunctional polyglycol having a hydroxyl or amine terminal group. In one embodiment of a two-step process, the anhydride based graft copolymers are prepared by solution polymerization in the presence of aromatic hydrocarbon solvents or ketone solvents. In a preferred process, the anhydride based graft copolymers are prepared by solution polymerization using incremental feed addition of the monomers and catalyst into a reactor containing an aromatic hydrocarbon or ketone solvent. The polymerization is conducted at the reflux temperature of the monomers and solvent mixture. The copolymer is isolated and reacted with polyethylene glycol to form the anhydride based graft copolymer.

The ethylenically unsaturated monomer is selected from vinyl esters, alpha-olefins, alkyl esters of acrylic and methacrylic acid, substituted or unsubstituted mono and dialkyl esters of unsaturated dicarboxylic adds, vinyl aromatics, unsubstituted or substituted acrylamides, cyclic monomers, monomers containing alkoxylated side chains, sulfonated monomers, and vinyl amide monomers. A combination of ethylenically unsaturated monomers may also be used.

Suitable vinyl esters are, for example, vinyl acetate, vinyl formate, vinyl propionate, vinyl butyrate, vinyl isobutyrate, vinyl valerate, vinyl 2-ethyl-hexanoate, vinyl isooctanoate, vinyl nonoate, vinyl decanoate, vinyl pivalate, and vinyl versatate. Suitable alkyl esters of acrylic and methacrylic acid are, for example, methyl acrylate, methyl methacrylate, ethyl acrylate, ethyl methacrylate, propyl acrylate, butyl acrylate, pentyl acrylate, hexyl acrylate, and 2-ethyl hexyl acrylate, etc. Suitable substituted or unsubstituted mono and dialkyl esters of unsaturated dicarboxylic acids are, for example, substituted and unsubstituted mono and dibutyl, mono and diethyl maleate esters as well as the corresponding fumarates. Suitable vinyl aromatic monomers preferably contain from 8 to 20 carbon atoms, most preferably from 8 to 14 carbon atoms. Examples of vinyl aromatic monomers are styrene, 1-vinyl napthalene, 2-vinyl napthalene, 3-methyl styrene, 4-propyl styrene, t-butyl styrene, 4-cyclohexyl styrene, 4-dodecyl styrene, 2-ethyl4-benzyl styrene, 4-(phenylbutyl) styrene, 3-isopropenyl-$\alpha$, $\alpha$-dimethylbenzyl isocyanate, and halogenated styrenes.

Suitable acrylamide based monomers are, for example, acrylamide, N, N-dimethylacrylamide, N-octyl acrylamide, N-methylol acrylamide, dimethylaminoethylacrylate, etc. Suitable cyclic monomers are, for example, vinyl pyrrolidone, vinyl imidazolidone, vinyl pyridine, etc. Suitable sulfonated monomers are, for example, 2-acrylamido-2-methyl propane sulfonic acid, sodium methallyl sufonate, sodium vinyl sulfonate, sulfonated sytrene, etc. Suitable vinyl amide monomers are, for example, N-vinyl formamide, N-vinyl acetamide, etc.

The anhydride monomer contains ethylenically unsaturation. Combinations of anhydride monomers may also be used in the invention. Preferably the anhydride monomer is selected from maleic anhydride or itaconic anhydride.

The polyglycol is preferably a monofunctional polyglycol having a terminal hydroxyl or amine group. Polyfunctional polyglycols having two or more terminal functional groups may be used in the compositions of the invention provided that such polyfunctional polyglycols have a weight average molecular weight of greater than 5,000 and at least one of the terminal function groups is a hydroxyl group.

Preferably, the polyglycol is a condensation product of an alkylene having 2 to 20 carbon atoms, preferably 2 to 6 carbon atoms. Suitable alkylene oxides are, for example, ethylene oxide, propylene oxide, butylene oxide, hexylene oxide, etc. The polyglycol can also be an alcohol ethoxylate wherein the alcohol is a linear or branched alkyl alcohol having 1 to 20 carbon atoms. Examples of such alcohols are hexanol, dodecanol, decanol etc. The alcohol can also be an aryl alcohol such as phenol or an alkylaryl alcohol such as nonyl phenol. Preferably the polyglycol is selected from a monofunctional polyethylene glycol having from about 6 to about 20 ethylene glycol repeating units, or a $C_5$–$C_{20}$ alcohol ethoxylate having from 6 to 10 moles of ethoxylation. Mixtures of polyglycols may also be used in the method of the invention.

In a preferred embodiment of the invention, the polyglycol has the formula $R^1$—$(CH_2CHR^3O)_m$—$R^2$ wherein $R^1$ is OH or $NH_2CHR^3CH_2$, $R^2$ is selected from an alkyl group having $C_1$–$C_4$ or phenol, m is from about 2 to about 20, and $R^3$ is independently H, methyl, ethyl, propyl, or phenyl.

In a second preferred embodiment of the invention, the polyglycol has the formula $R^1$—$(CH_2CHR^3O)_m$—$(CH_2)_n$—H wherein $R^1$ is OH or $NH_2$ $CHR^3CH_2$, m is from about 2 to about 20, and n is from about 5 to about 20. More preferably, m is from about 5 to about 10 and n is from about 12 to about 15.

The free radical initiator can be any initiator which is capable of generating free radicals. Some representative examples of free radical initiators which may be used to prepare the polymers of the invention are the various persulfates, percarbonates, perborates, peroxides, azo compounds, and perketals. Such free radical initiators are known to those skilled in the art.

The choice of free radical initiator and amount employed will depend on the reactivity of the initiator. Preferably, the free radical initiator is present in an amount of from about 0.01 to about 10 weight percent, preferably from about 0.1 to about 2 weight percent, based on the total weight of monomers in the polymerization reactor. It is noted that using too much of a very reactive initiator in the polymerization reaction may cause excessive grafting which may result in crosslinking between side chains and the formation of an insoluble gel which is undesirable.

Sizing may be carried out using solutions of the anhydride based graft copolymer having a total polymer concentration of from 1 to 50 weight percent, preferably from 4 to 20 weight percent The sizing composition may incorporate other materials typically found in sizing compositions. Such additional materials are, for example, waxy-type lubricants, starch, polyvinyl alcohol, defoaming surfactants, and other surfactants. A skilled artisan will be able to judge what concentration size solution to use to achieve his desired size add-on level, and what additives are best suited to his operations.

Because of the cleaning properties of the anhydride based graft copolymers of the invention, desizing removes oils, wax and dirt more effectively than would occur with standard desizing procedures. Desizing of sized fabrics is commonly carried out using water washing at varying temperatures. Desizing can also be carried out effectively with alkaline, preferably caustic solutions, and those alkaline solutions can be very dilute. Alkaline desizing solutions can be as dilute as about 0.001 weight percent, particularly if somewhat elevated temperatures are used to desize, though concentrations about 0.05 weight percent will more often be required. Generally, more rapid, lower temperature or more complete desizing is possible as the concentration is increased. Generally, the alkaline will have to be subsequently washed out, so that higher concentration alkaline than is adequate should be avoided. The alkaline desizing solutions should have, at the most, a concentration of 10 weight percent Preferably however, they should be below 2 weight percent, and most preferably between 0.1 and 1.5 weight percent For any particular anyhydride based graft copolymer size, add-on level, fabric heat treatment, a suitable concentration for the desizing alkaline solution and a suitable temperature for desizing can be readily determined when it has been decided how rapidly and how completely desizing is required. Thus the emphasis may be on the most rapid desizing for economic reasons. Or the emphasis may be on as low temperature desizing as possible because the material is somewhat temperature sensitive. Suitable alkaline materials include any of the alkaline metal hydroxides or carbonates, i.e., sodium, potassium or lithium, with sodium hydroxide being preferred.

Fibers treated with the anhydride based graft copolymers of the invention may undergo scouring to remove soil and lubricants after desizing. In the alterative, untreated fibers may undergo scouring prior to further operations such as carding, spinning, weaving, knitting, etc. These further operations may require the application of lubricants and sizes, so that further scouring is needed to prepare the fabric for dyeing or printing. In any case, the anhydride based graft copolymers of the invention increase the removal of soil and lubricants from fibers or textiles during scouring.

Scouring generally takes place using mild alkalinity and surfactants as wetting agents, such as alkylbenzenesulfonate and alkylphenol ethoxylates, to clean the fibers. Some surfactants are generated in the scouring of raw fiber, as the fats present become hydrolyzed, producing soaps. Wool and silk are sensitive to alkaline, tending to hydrolyze, therefore, milder alkalinity is needed for them than for cotton or linen. Synthetic fibers are generally free from soil, except for applied lubricants, needing only mild washing. Blends of synthetic and natural fibers are generally treated with respect to the natural fiber component, since the natural fiber component usually has the most soil. For example, cotton, requires high alkalinity scouring, which swells the fibers, allowing access to the lumen and removing soil from the surface.

The following nonlimiting examples illustrate further aspects of the invention.

EXAMPLE 1

Preparation of Styrene-Maleic Anhydride Graft Copolymer Using Solvent

Styrene-maleic anhydride resin (SMA 1000 from Elf Atochem), 15 grams, was slurried in an amine terminated poly(oxypropylene-b-oxyethylene) copolymer (JEFFAMINE XTJ 505 from Huntsman). The reaction mixture was heated to 90° C. and the temperature was maintained for a period of 6 hours. The reaction product was a viscous yellow oil which was cooled. The product was dissolved in 100 grams of 2-propanol which formed an amber colored liquid.

EXAMPLE 2

Preparation of Styrene-Maleic Anhydride Graft Copolymer Using Solvent

Styrene-maleic anhydride resin (SMA 1000 from Elf Atochem), 20 grams, was slurried in 39.6 grams of ethoxy polyethylene glycol (CARBOWAX 550 from Union Carbide), 13.5 grams of NEODOL 25-9 and 26.1 grams of NEODOL 25-7 from Shell Chemical. The reaction mixture was heated to 110° C. for 2 hours and the temperature was raised to 140° C. for 3 hours. The reaction product was a clear yellow oil solution which was cooled. Water, 226.1 grams was added. The pH of the solution was then adjusted to between 6 and 7 using about 2 mls of 50% NaOH solution. The final solids of the reaction product was approximately 30 percent.

EXAMPLE 3

Preparation of Styrene-Maleic Anhydride Graft Copolymer Using Solvent

Styrene-maleic anhydride resin (SMA 1000 from Elf Atochem), 20 grams, was slurried in 29.7 grams of ethoxy polyethylene glycol (CARBOWAX 550 from Union Carbide), 10.1 grams of NEODOL 25-9 and 19.8 grams of NEODOL 25-7 from Shell Chemical. The reaction mixture was heated to 160° C. and held at that temperature for a period of 6 hours. The reaction product was a clear viscous yellow oil solution which was cooled and diluted with 185.7 grams of water. The pH of the solution was adjusted to between 6 and 7 using about 2 mls of 50% NaOH solution. The final solids of the reaction product was determined to be approximately 30 percent

EXAMPLE 4

Preparation of Styrene-Maleic Anhydride Graft Copolymer Using Solvent

Styrene-maleic anhydride resin (SMA 1000 from Elf Atochem), 20 grams was slurried in 19.7 grams of ethoxy polyethylene glycol (CARBOWAX 550 from Union Carbide), 13.5 grams of NEODOL 25-9 and 26.4 grams of NEODOL 25-7 from Shell Chemical. The reaction mixture was heated to 160° C. and held at that temperature for a period of 6 hours. The reaction product was a clear yellow oil solution which was cooled and diluted with 185.7 grams of water. The pH of the solution was then adjusted to between 6 and 7 using a6out 2 mls of 50% NaOH solution. The final solids of the reaction product was determined to be approximately 30 percent.

EXAMPLE 5

Evaluation of Soil Release Properties of Copolymers Prepared in Examples 1–4.

The styrene-maleic anhydride graft copolymers prepared in Examples 1–4 were evaluated in a soil release test and compared to a commercial soil release polymer (SRP4 from Rhone-Poulenc) which is commonly used to remove soil from polyesters. In this test, three swatches were prewashed in a TERG-O-TOMETER at a temperature of 93° F., 110 ppm water hardness and 80 rpm agitation using 0.5 g/L of AATCC detergent and 9 ppm of one of the polymers prepared in Examples 1–4 or SRP4. Each of the swatches was dried and stained with spaghetti sauce. The swatches were washed in a TERG-O-TOMETER at a temperature of 93° F., 110 ppm water hardness and 80 rpm agitation using 0.5 g/L of AATCC detergent and 9 ppm of one of the polymers prepared in Examples 1–4 and SRP4. The soil release properties for each of the swatches is summarized in Table I.

TABLE I

| Copolymer | % Soil Release on Polyester | % Soil Release on Cotton |
|---|---|---|
| None | 53.8 | 51.8 |
| SRP4 | 72.0 | — |
| EX. 1 | 73.3 | 51.5 |
| EX. 2 | 74.0 | 65.1 |
| EX. 3 | 74.3 | 65.5 |
| EX. 4 | 68.6 | 64.9 |

The test results in Table I clearly show that the styrene-maleic anhdyride graft copolymers prepared in Examples 1–4 exhibit excellent soil release on cotton and polyester as compared to untreated cotton and polyester. In addition, the styrene-maleic anhydride graft copolymers prepared in Examples 1–4 exhibit excellent soil release on cotton and polyester while the commercially available SRP4 polymer only exhibits soil release on polyester.

EXAMPLE 6

Solventless Method for Preparing Styrene-Maleic Anhydride Graft Copolymer

Styrene, 30.9 grams, and 29.1 grams of maleic anhydride was stirred with 216.0 grams of CARBOWAX methoxy polyethylene glycol 550 (from Union Carbide), 8.2 grams of NEODOL 25-9 and 15.8 grams of NEODOL 25-7 (both obtained from Shell Chemical) which formed a homogeneous clear/colorless mixture. The mixture was heated to 50° C. and 1.2 grams of lauroyl peroxide and 1.2 grams of dicumyl peroxide were added while a nitrogen blanket was introduced. The reaction temperature was increased to 116.5° C. over a 2 hour period of time. It was observed that at 74° C. the mixture became pale yellow, hazy/milky in appearance. It was observed that at 92° C. the mixture became peach colored, hazy/milky in appearance. The reaction temperature was increased to 152° C. over a 1 hour period of time and held at that temperature for 30 minutes wherein the mixture appeared rose colored and clear. The reaction product was cooled.

The reaction product was diluted to 30% "activity" with tap water to form a solution. As used herein, "activity" is the neat polymeric product obtained from the in situ polymerization/esterificafion. The pH of the solution was adjusted from 2.7 to 6.3 using 10.8 grams of a 50% solution of NaOH. The solution was pink and clear which changed to a golden yellow color after 2 days.

EXAMPLE 7

Solventless Method for Preparing Styrene-Maleic Anhydride Graft Copolymer

Styrene, 30.9 grams, and 29.1 grams of maleic anhydride was stirred with 168.0 grams of CARBOWAX methoxy polyethylene glycol 550 (from Union Carbide), 24.6 grams of NEODOL 25-9 and 47.4 grams of NEODOL 25-7 (both obtained from Shell Chemical) which formed a homogeneous clear/colorless mixture. The mixture was heated to 50° C. and 1.2 grams of lauroyl peroxide and 1.2 grams of dicumyl peroxide were added while a nitrogen blanket was introduced. The reaction temperature was increased to 125° C. over a 2 hour period of time. It was observed that at 63° C. the mixture became pale yellow, hazy in appearance, at 93° C. the mixture became orange/yellow in appearance, at 105° C. the mixture became yellow, almost clear, at 110° C. the mixture became orange and clear. The reaction temperature was increased to 148° C. over a 1 hour period of time and held at that temperature for 45 minutes. It was observed that at 146° C. the mixture became rose color and clear. The reaction product was cooled.

The reaction product was diluted to 30% "activity" with tap water to form a solution. As used herein, "activity" is the neat polymeric product obtained from the in situ polymerization/esterification. The pH of the solution was adjusted from 2.7 to 6.5 using 11.1 grams of a 50% solution of NaOH. The solution was pink and clear which changed to a golden yellow color after 2 days.

EXAMPLE 8

Solventless Method for Preparing Styrene-Maleic Anhydride Graft Copolymer

Styrene, 30.9 grams, and 29.1 grams of maleic anhydride was stirred with 120 grams of CARBOWAX methoxy polyethylene glycol 550 (from Union Carbide), 41 grams of NEODOL 25-9 and 79 grams of NEODOL 25-7 (both obtained from Shell Chemical) which formed a homogeneous clear/colorless mixture. The mixture was heated to 50° C. and 0.3 grams of lauroyl peroxide and 0.3 grams of dicumyl peroxide were added while a nitrogen blanket was introduced. The reaction temperature was increased to 110° C. over a 2 hour period of time. It was observed that at 63° C. the mixture became pale yellow and clear, in appearance, at 68.5° C. the mixture became pale yellow and hazy in appearance, at 95° C. the mixture became yellow, almost clear, at 103° C. the mixture became yellow and clear. The reaction temperature was increased to 152° C. over a 1 hour period of time and held at that temperature for 130 minutes. It was observed that at 142° C. the mixture became light pink and clear. The reaction product was cooled.

The reaction product was diluted to 30% "activity" with tap water to form a solution. As used herein, "activity" is the neat polymeric product obtained from the in situ polymerization/esterification. The pH of the solution was adjusted from 2.7 to 6.8 using 11 grams of a 50% solution of NaOH. The solution was pink and clear which changed to a golden yellow color after 2 days.

EXAMPLE 9

Each of the anhydride based graft copolymers, 2 grams, prepared in Examples 2–4 and 7–9 were spotted on a stained swatch and allowed to sit overnight The stained swatch was dust/sebum on cotton (available from Test Fabrics). The swatch was washed in a TERG-O-TOMETER using 0.9 g/l AATCC detergent at 93° F., 80 rpm and 110 ppm water hardness using a 10 minute wash and 5 minute rinse. The L, a, and b values were measured before and after the wash. The ΔE was calculated from the following equation: $\Delta E = [(L_1-L_2)^2 + (a_1=a_2)^2 + (b_1-b_2)^2]^{0.5}$. The test results are summarized in Table II.

TABLE II

Results of the anhydride based graft copolymers on Dust-Sebum stains.

| Copolymer | ΔE for prespotter test without detergent |
|---|---|
| None | 4.5 |
| Ex. 2 | 13.0 |
| Ex. 3 | 14.9 |
| Ex. 4 | 15.7 |
| Ex. 7 | 13.6 |
| Ex. 8 | 15.6 |
| Ex. 9 | 16.7 |

The results in Table II show that the anhydride based graft copolymers of the invention performed significantly better as prespotters for removing stains from cloth than the control which did not use a polymer. This example demonstrates the cleaning or stain removal properties of the anhydride based graft copolymers during desizing.

EXAMPLE 10

The anhydride based graft copolymers prepared by the two-step process utilizing solvent in Examples 2–4 and the anhydride based graft copolymers prepared by the in situ solvent-free process in Examples 6–8 were evaluated for film forming properties. Conventional sizes, in particular starch and polyvinyl alcohol, were also evaluated for film forming properties. The starch was FIBERSIZE which is available as a powder from National Starch and Chemical and the polyvinyl alcohol was ELVANOL 51-05 which is available as a powder from DuPont A 30% polymer solution in water was prepared for each copolymer. A 10% solution in water was prepared for the starch and a 10% solution was prepared for the polyvinyl alcohol. Two grams of each solution was placed in an aluminum pan having a 2 inch diameter. The aluminum pan was placed in an oven having a temperature of 140° C. for two hours to allow the water to 15 evaporate. The test results are summarized in Table III.

TABLE III

Results of Film Forming Evaluations

| Polymer | Film properties |
|---|---|
| Example 2 | clear waxy film |
| Example 3 | clear waxy film |
| Example 4 | clear waxy film |
| Example 6 | clear waxy film |
| Example 7 | clear waxy film |
| Example 8 | clear waxy flm |
| Starch | brittle non waxy flm |
| Poly vinyl alchohol | brittle non waxy film |

The test results in Table III clearly show that the anhydride based graft copolymers of the invention form a waxy film and therefore do not require the addition of waxy-type lubricants when used in sizing compositions in order to lubricate the fibers. In contrast, the conventional sizes, starch and polyvinyl alcohol form brittle non waxy films which require the addition of waxy-type lubricants when used in sizing compositions to lubricate the fibers.

The examples also show that size compositions prepared using the anhydride based graft copolymers of the invention exhibit excellent soil release properties due to the hydrophobic backbone and hydrophillic chains of the anhydride based graft copolymer, and thus provide a more complete removal of natural and synthetic waxes and oils from fabrics during desizing as compared to conventional sizes. The data indicates that the anhydride based graft copolymers enhance the soil removal properties of the sizes prepared therefrom. Moreover, due to the hydrophilic nature of the anhydride based graft copolymer, the copolymer is soluble in alkaline medium and is readily desized. In addition, articles sized with the sizing compositions of the invention may not require a scouring step due to the cleaning ability of the anhydride based graft copolymer during desizing.

While the invention has been described with particular reference to certain embodiments thereof, it will be understood that changes and modifications may be made by those of ordinary skill in the art within the scope and spirit of the following claims.

What is claimed is:

1. A sizing composition comprising 1 to 50 weight percent, based on the total weight of the sizing composition, of an anhydride based graft copolymer comprising the reaction product of an ethylenically unsaturated monomer, an anhydride monomer selected from the group consisting of maleic anhydride, itaconic anhydride, and mixtures thereof, a monofunctional polyglycol having the formula selected from the group consisting of:

a) $R^1$—$(CH_2CHR^3O)_m$—$R^2$ wherein $R^1$ is OH or $NH_2CHR^3CH_2$, $R^2$ is an alkyl group having $C_1$–$C_4$ or phenol, m is from about 2 to about 20, and $R^3$ is independently H, methyl, ethyl, propl, or phenyl;

b) $R^1$—$(CH_2CHR^3O)_m$—$(CH_2)_n$—H in which $R^1$ is OH or $NH_2CHR^3CH_2$, m is from about 2 to about 20, n is from about 5 to about 20, and $R^3$ is independently selected from the group consisting of H, methyl, ethyl, propyl, and phenyl;

or mixtures thereof, and a free radical initiator.

2. A sizing composition comprising 1 to 50 weight percent, based on the total weight of the sizing composition, of an anhydride based graft copolymer prepared by a two-step process comprising (i) reacting an ethylenically unsaturated monomer and an anhydride monomer selected from the group consisting of maleic anhydride, itaconic anhydride, and mixtures thereof, and a free radical initiator, in the presence of a solvent; and (ii) isolating the product from the solvent and reacting the product with a monofunctional polyglycol having the formula selected from the group consisting of;

a) $R^1$—$(CH_2CHR^3O)_m$—$R^2$ wherein $R^1$ is OH or $NH_2CHR^3CH_2$, $R^2$ is an alkyl group having $C_1$–$C_4$ or phenol, m is from about 2 to about 20, and $R^3$ is independently H, methyl, ethyl, propyl or phenyl;

b) $R^1$—$(CH_2CHR^3O)_m$—$(CH_2)_n$—H in which $R^1$ is OH or $NH_2CHR^3CH_2$, from about 2 to about 20, n is from about 5 to about 20, and $R^3$ is independently selected from the group consisting of H, methyl, ethly, propyl, and phenyl;

or mixtures thereof, to form the anhydride based graft copolymer.

3. A textile material treated with the composition according to claim 1.

4. The composition according to claim 1 in which the ethylenically unsaturated monomer is selected from the group consisting of vinyl esters, alpha olefins, alkyl esters of acrylic and methacrylic acid, substituted or unsubstituted mono and dialkyl esters of unsaturated dicarboxylic acids, unsaturated carboxylic acids, vinyl aromatics, unsubstituted or substituted acrylamides, cyclic monomers, sulfonated monomers, vinyl amide monomers, and combinations thereof.

5. The composition according to claim 1 in which the ethylenically unsaturated monomer is a vinyl ester selected from the group consisting of vinyl acetate, vinyl formate, vinyl propionate, vinyl butyrate, vinyl isobutyrate, vinyl valerate, vinyl 2-ethyl-hexanoate, vinyl isooctanoate, vinyl nonoate, vinyl decanoate, vinyl pivalate, and vinyl versatate.

6. The composition according to claim 1 in which the ethylenically unsaturated monomer is an alkyl ester selected from the group consisting of methyl acrylate, methyl methacrylate, ethyl acrylate, ethyl methacrylate, and butyl acrylate.

7. The composition according to claim 1 in which the ethylenically unsaturated monomer is a substituted or unsubstituted mono or dialkyl ester of an unsaturated dicarboxylic acid selected from the group consisting of substituted and unsubstituted mono and dibutyl maleate esters, mono and diethyl maleate esters, and the corresponding fumarates of such esters.

8. The composition according to claim 1 in which the ethylenically unsaturated monomer is an unsaturated carboxylic acid selected from the group consisting of crotonic acid, acrylic acid, methacrylic acid, fumaric acid, maleic acid, itaconic acid, and citraconic acid.

9. The composition according to claim 1 in which the ethylenically unsaturated monomer is a vinyl aromatic monomer selected from the group consisting of styrene, 1-vinyl napthalene, 2-vinyl napthalene, 3-methyl styrene, 4-propyl styrene, t-butyl styrene, 4-cyclohexyl styrene, 4-dodecyl styrene, 2-ethyl-4-benzyl styrene, and 4-(phenylbutyl) styrene.

10. The composition according to claim 1 in which the ethylenically unsaturated monomer is an acrylamide based monomer selected from the group consisting of acrylamide, N, N dimethylacrylamide, N-octyl acrylamide, N-methylol acrylamide, and dimethylaminoethylacrylate.

11. The composition according to claim 1 in which the ethylenically unsaturated monomer is a cyclic monomer selected from the group consisting of vinyl pyrrolidone, vinyl imidazolidone, and vinyl pyridine.

12. The composition according to claim 1 in which the ethylenically unsaturated monomer is a sulfonated monomer selected from the group consisting of 2-acrylamido-2-methyl propane sulfonic acid, sodium methallyl sufonate, sodium vinyl sulfonate, and sulfonated sytrene.

13. The composition according to claim 1 in which the ethylenically unsaturated monomer is a vinyl amide monomer selected from the group consisting of N-vinyl formamide and N-vinyl acetamide.

14. The composition according to claim 1 in which the ethylenically unsaturated monomer is an $\alpha$-olefin based monomer selected from the group consisting of 1-octene, butylene, and 1-dodecene.

15. The composition according to claim 1 in which the ethylenically unsaturated monomer is selected from the group consisting of styrene, vinyl acetate, vinyl pyrrolidone, acrylamide, and 2-acrylomido-2-methyl propane sulfonic acid.

16. The composition according to claim 1 in which the polyglycol is an alcohol ethoxylate in which the alcohol is a linear or branched alkyl alcohol having 1 to 20 carbon atoms.

17. The composition according to claim 1 in which the polyglycol is a methoxy polyethylene glycol having a weight average molecular weight of about 550.

18. The composition according to claim 1 in which the free radical initiator is selected from the group consisting of persulfates, percarbonates, perborates, peroxides, perketals, azo compounds, and combinations thereof.

* * * * *